US005671879A

United States Patent [19]

Lin

[11] Patent Number: 5,671,879

[45] Date of Patent: Sep. 30, 1997

[54] LOW-NOISE POWER STAPLER

[76] Inventor: Liang-Peng Lin, 4 F., No. 282, Section 2, Li Nung Street, Taipei City, Taiwan

[21] Appl. No.: 645,820

[22] Filed: May 14, 1996

[51] Int. Cl.[6] ..... B25C 1/06; B27F 7/36

[52] U.S. Cl. ..... 227/7; 227/123; 227/131; 227/134

[58] Field of Search ..... 227/120, 131, 227/7, 6, 155, 132, 134, 128, 123

[56] References Cited

U.S. PATENT DOCUMENTS

| | | | |
|---|---|---|---|
| 4,186,863 | 2/1980 | Yunoki | 227/131 |
| 4,726,505 | 2/1988 | Okazaki | 227/131 |
| 5,012,967 | 5/1991 | Johansson | 227/7 |
| 5,195,671 | 3/1993 | Shimomura et al. | 227/7 |
| 5,222,645 | 6/1993 | Sueda | 227/7 |
| 5,230,457 | 7/1993 | Hiroi et al. | 227/131 |
| 5,427,296 | 6/1995 | Chen | 227/131 |

*Primary Examiner*—Scott A. Smith

*Attorney, Agent, or Firm*—Morton J. Rosenberg; David I. Klein

[57] ABSTRACT

A power stapler in which the electromagnetic valve has a movable annular metal block which moves downwards to prevent the occurrence of a high striking noise when attracts the valve rod to strike the striking plate; the guard plate which stops staples in the magazine can be alternatively adjusted to the closed position to close the front end of the magazine, the open position to open the front end of the magazine for the loading of staples, or the mid-way position to partially close the front end of the magazine for permitting jammed staples to be removed from the magazine.

5 Claims, 6 Drawing Sheets

LOW-NOISE POWER STAPLER

BACKGROUND OF THE INVENTION

The present invention relates to power staplers, and relates more particularly to a low-noise power stapler which prevents the occurrence of a high striking noise during the down stroke of the striking plate and, which permits the guard plate to be opened from the front end of the magazine during a trouble-shooting procedure.

Various power staplers have been disclosed, and have appeared on the market. Conventional power staplers commonly use an electromagnetic valve to drive the striking plate, and a contact switch to control the operation of the electromagnetic valve. These power staplers are functional, however they still have numerous drawbacks as follows: (1) when the electromagnetic valve is operated, a high striking noise will be produced; (2) 2f staples are jammed in the front end of the magazine, they cannot be conveniently removed from the magazine, thereby causing the striking plate to be stuck in the magazine; (3) the contact switch which controls the operation of the electromagnetic valve is fixed in position, therefore it cannot be adjusted subject to the thickness of the sheets of paper to be fastened or the change of the striking position; (4) the position of the anvil cannot be adjusted subject to the amount of the sheets of paper to be fastened.

SUMMARY OF THE INVENTION

The present invention has been accomplished to provide a power stapler which eliminates the aforesaid drawbacks. According to one aspect of the present invention, the electromagnetic valve has a movable annular metal block which moves downwards to prevent the occurrence of a high striking noise when attracts the valve rod to strike the striking plate. According to another aspect of the present invention, the front end of the magazine is an open end closed by a guard plate. The guard plate can be alternatively adjusted to the closed position to close the front end of the magazine, the open position to open the front end of the magazine for the loading of staples, or the midway position to partially close the front end of the magazine for permitting jammed staples to be removed from the magazine. According to still another aspect of the present invention, the anvil assembly of the power stapler is mounted in a hole on the base thereof, and adjusted horizontally by adjusting screws and vertically by an elevation adjusting device.

DETAILED DESCRIPTION OF THE PREFERRED EMBODIMENT

Figure 1:
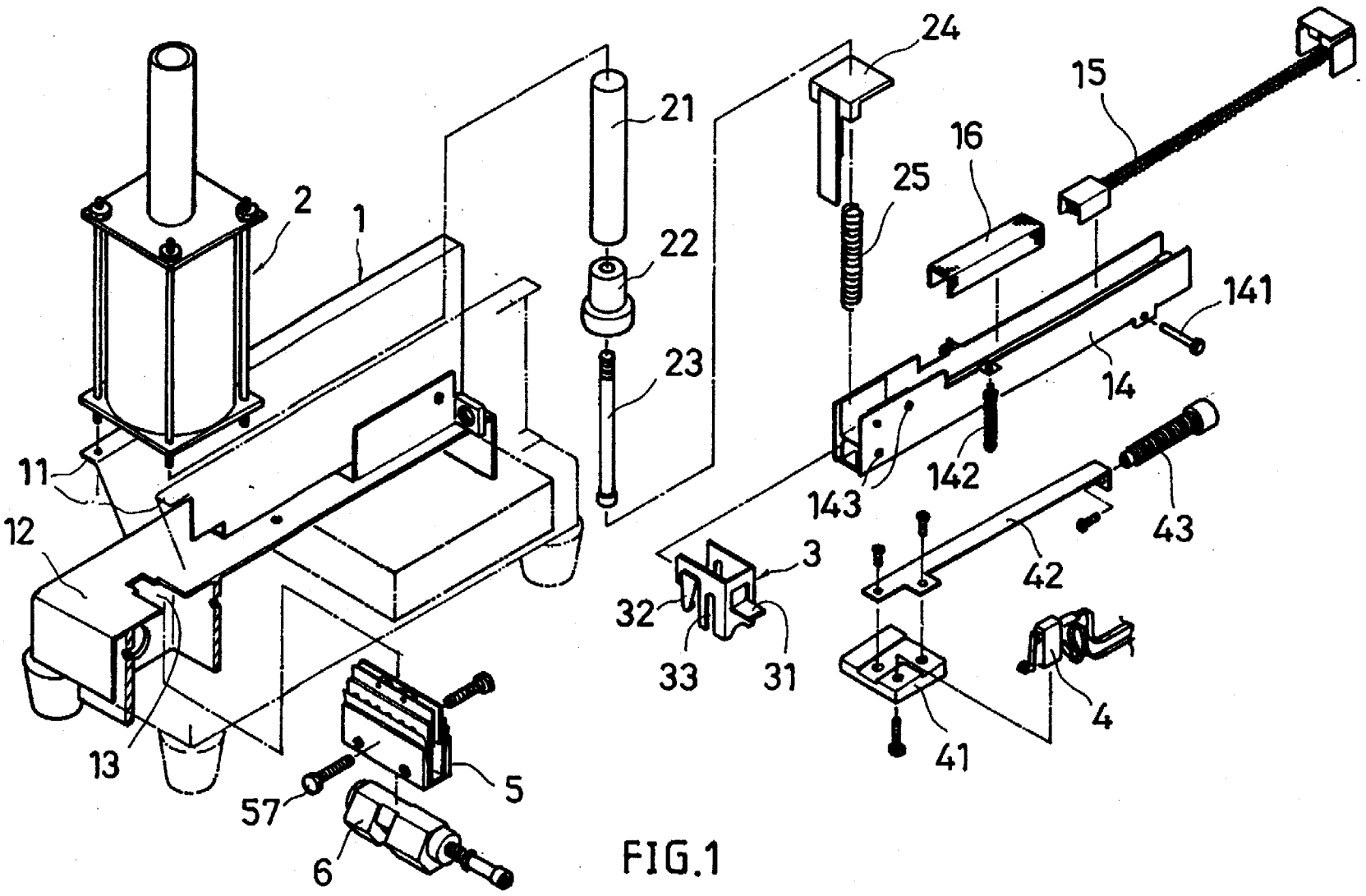
FIG. 1 is an exploded view of a power stapler according to the present invention.
Figure 2:
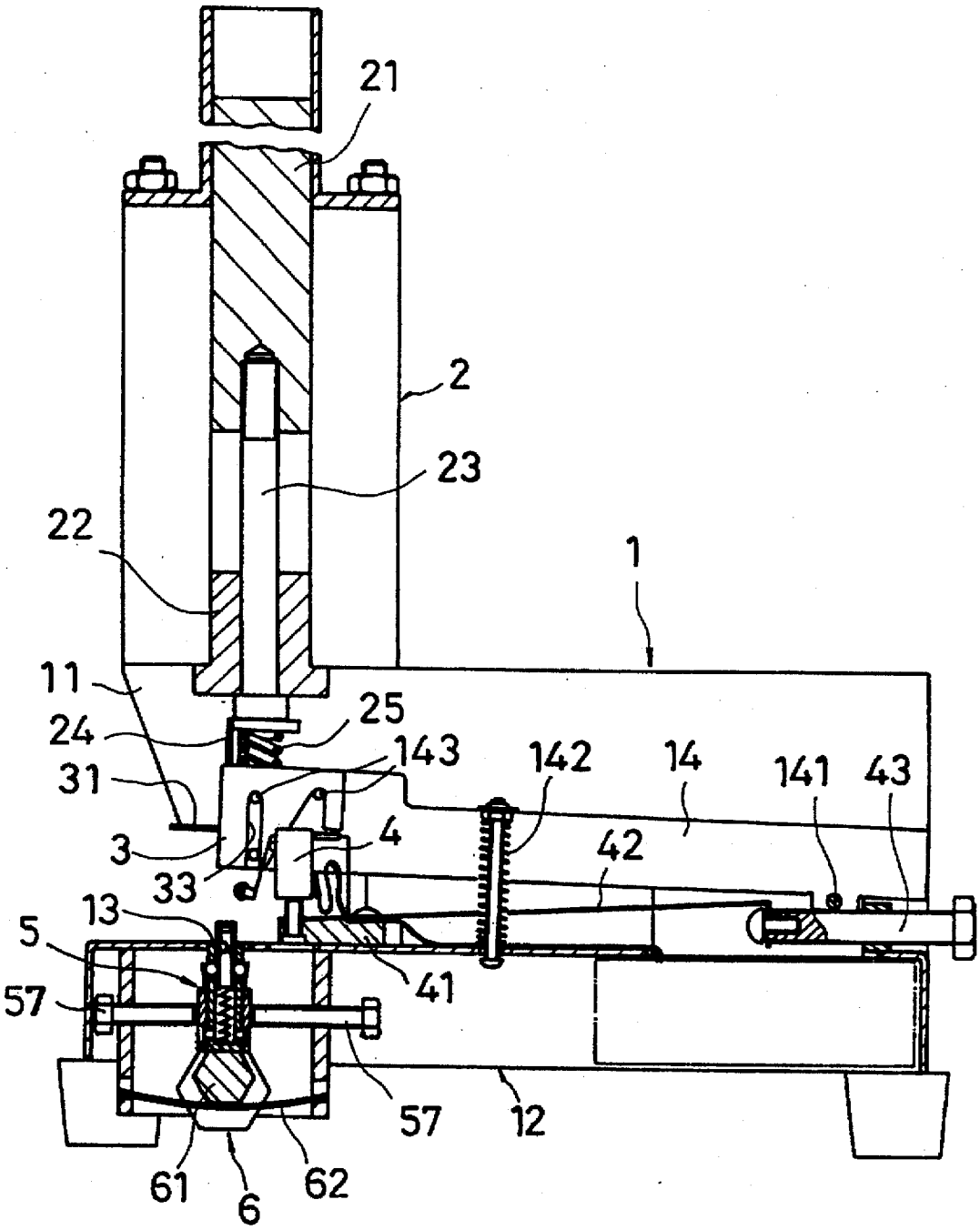
FIG. 2 is side view in section of the power stapler shown in FIG. 1.

Referring to FIGS. 1 and 2, the power stapler of the present invention comprises a base 1. The base 1 is comprised of a bottom frame 12, and two parallel upright frames 11 raised from the bottom frame 12. An electromagnetic valve 2 is mounted on the upright frames 11, comprising a valve rod 21 vertically disposed at the top, a movable annular metal block 22 disposed at the bottom, and a plunger 23 having a top end fixedly connected to the valve rod 21 and a bottom end inserted through the annular metal block 22 and stopped above a striking plate 24. The striking plate 24 is supported on a spring 25. A magazine 14 is mounted within the space defined between the upright frames 11 to carry a bar of staples 16. The rear end of the magazine 14 is pivoted to the bottom frame 12 by a pivot 141. Two springs 142 are bilaterally connected between the middle part of the magazine 14 and the bottom frame 12. When the electromagnetic valve 2 is turned on, the movable annular metal block 22 is energized to attract the valve rod 21, causing the valve rod 21 to force the plunger 23 downwards, therefore the striking plate 24 is forced to drive out one staple. The electromagnetic valve 2 is disenergized, the striking plate 24 and the plunger 23 are pushed back to their former positions by the spring 25. Because the annular metal block 22 is movable, it is forced downwards when attracting the valve rod 21, and little noise is produced when the valve rod 21 strikes the annular metal block 22.

Figure 3A:
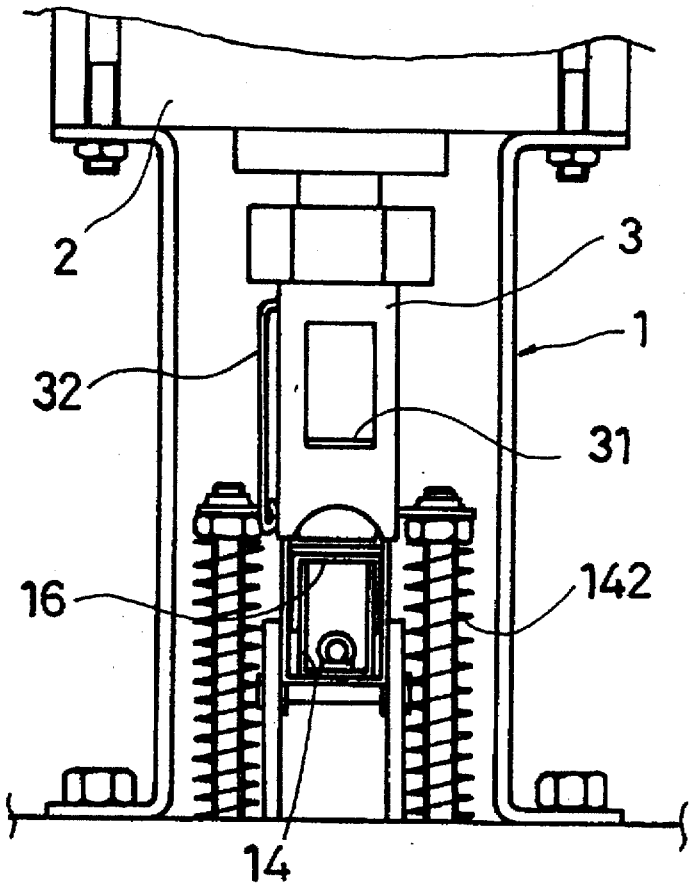
FIG. 3A is a front end view in section of the power stapler shown in FIG. 1.
Figure 3B:
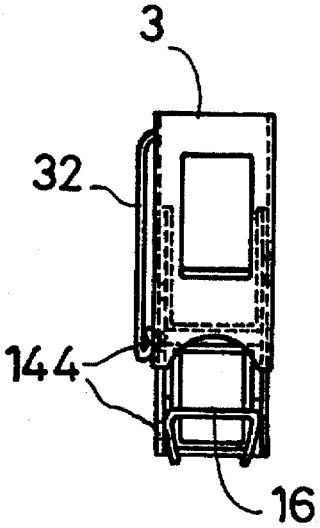
FIG. 3B is a partial view of the present invention, showing the guard plate retained in the midway position.
Figure 3C:
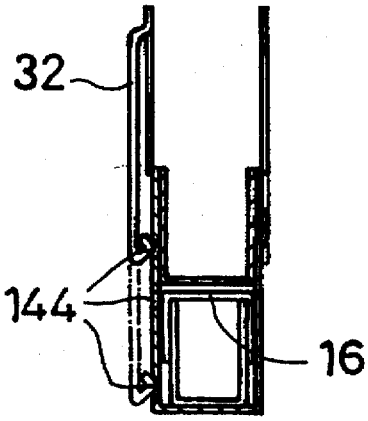
FIG. 3C is a schematic drawing showing the spring locating element of the guard plate moved between the locating holes of the magazine.

Referring to FIGS. 3A, 3B, and 3C, a guard plate 3 is disposed in front of the front end of the magazine 14. The guard plate 3 comprises two locating grooves 33 at two opposite lateral sides respectively and movably coupled to two locating pins 143, which are bilaterally mounted on the magazine 14 near its front end, a finger strip 31 at the front side for lifting by hand, and a springy locating element 32 at one lateral side forced into engagement with one of three vertically spaced locating holes 144 at one lateral side of the magazine 14. Through the finger strip 31, the guard plate 3 can be moved with the fingers to shift springy locating element 32 from one locating hole 144 to another. When the springy locating element 32 is forced into engagement with the lowest one of the three locating holes 144, the guard plate 3 is closed on the front end of the magazine 14. When the springy locating element 32 is forced into engagement with the intermediate one of the three locating holes 144, the guard plate 3 is partially closed on the front end of the magazine 14 to stop the bar of staples 16 inside the magazine 14, and the jammed stapled can be quickly taken away. When the springy locating element 32 is forced into engagement with the top one of the three locating holes 144, the guard plate 3 is opened from the front end of the magazine 14, the bar of staples 16 can be replaced.

Figure 4:
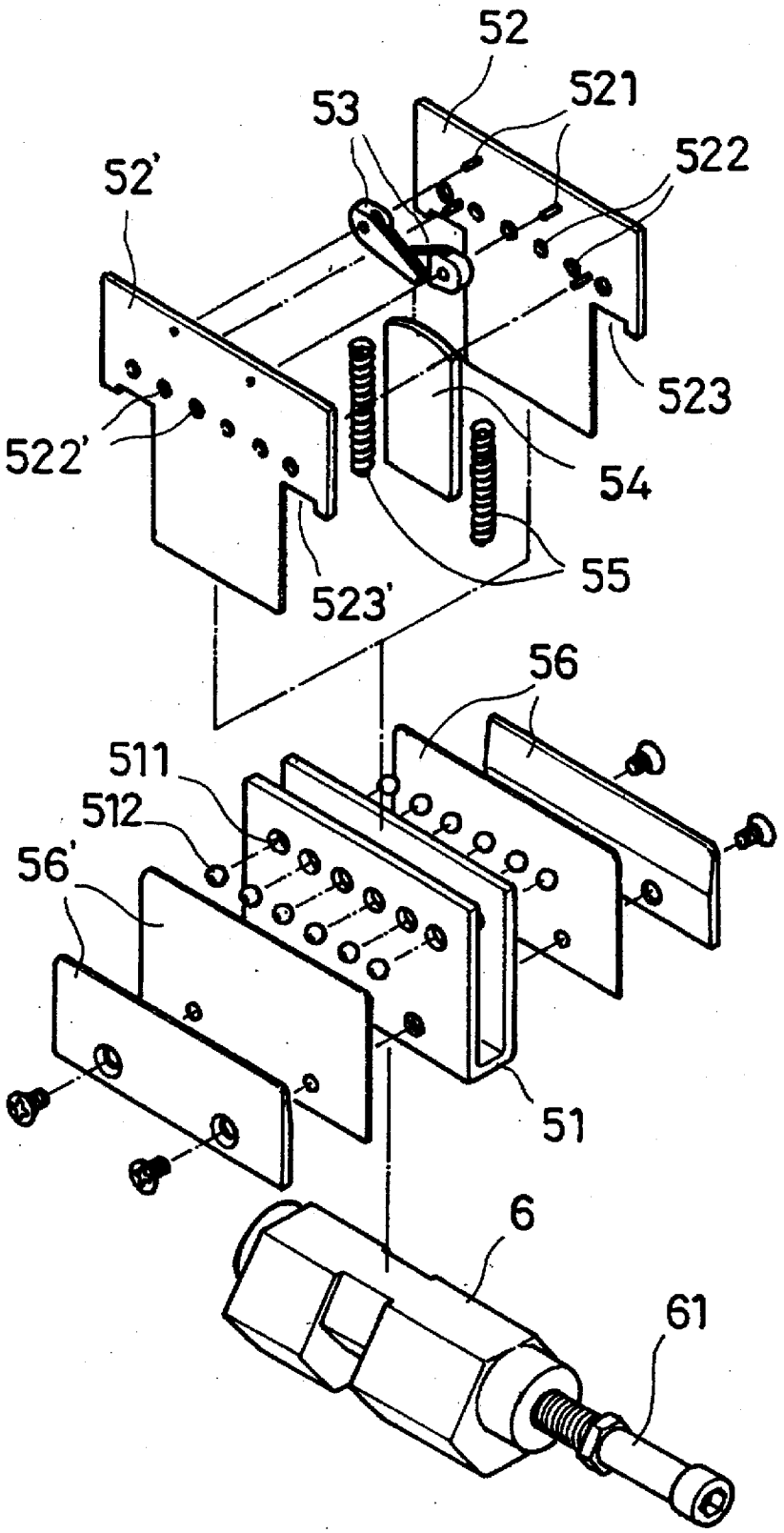
FIG. 4 is an exploded view in an enlarged scale of the anvil assembly shown in FIG. 1.
Figure 5A:
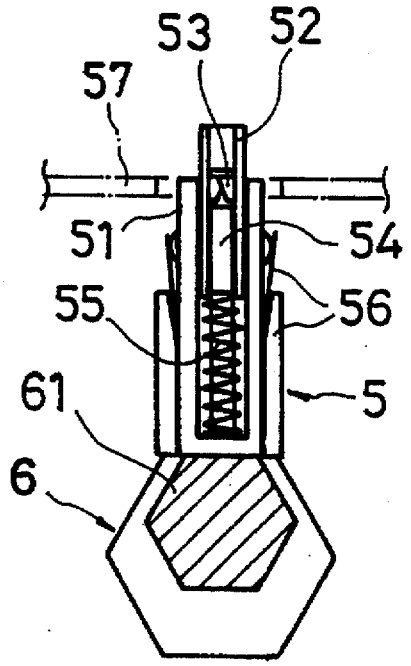
FIG. 5A is a sectional view showing one side of the elevation adjusting device disposed in contact with the anvil assembly, and the anvil assembly retained in the lowest position.
Figure 5B:
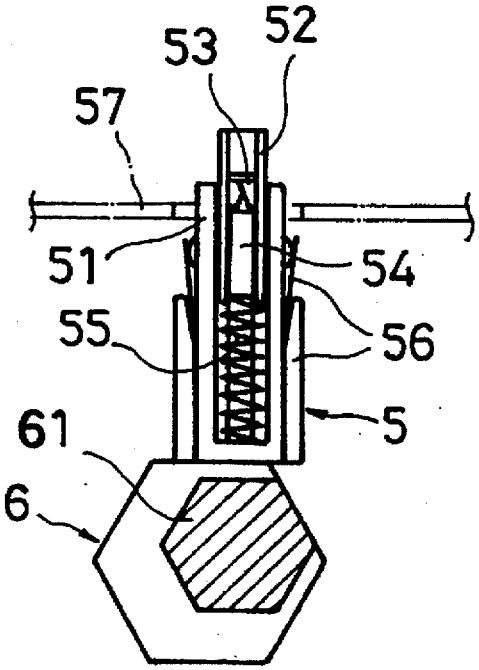
FIG. 5B is similar to FIG. 5A but showing a second side of the elevation adjusting device disposed in contact with the anvil assembly.
Figure 5C:
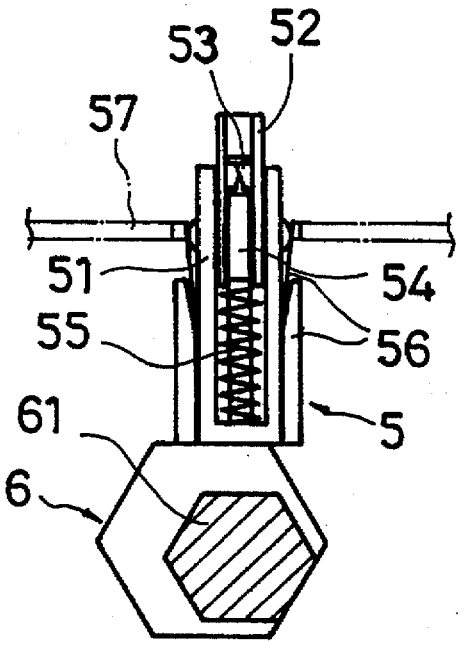
FIG. 5C is similar to FIG. 5A but showing a third side of the elevation adjusting device disposed in contact with the anvil assembly.
Figure 5D:
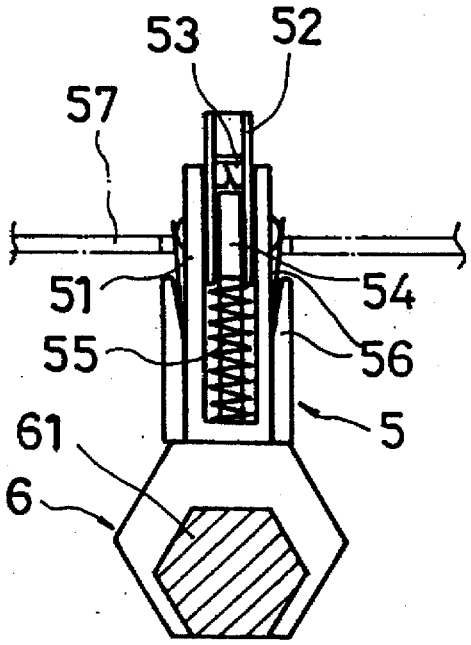
FIG. 5D is similar to FIG. 5A but showing a fourth side of the elevation adjusting device disposed in contact with the anvil assembly, and the anvil assembly retained in the lowest position.

Referring to FIG. 4, the bottom frame 12 has an anvil mounting hole 13 at the top. An anvil assembly 5 is mounted in the anvil mounting hole 13 and supported on an elevation adjusting device 6. The anvil assembly 5 comprises a channel plate 51, pairs of clamping plates 56, 56' symmetrically fastened to two opposite sides of the channel plate 51 by adjusting screws 57, two flat holder plates 52, 52' mounted in the channel plate 51 and supported on springs 55, a support 54 mounted in the channel plate 51 between the holder plates 52, 52', and two tapered actuating members 53 coupled between the holder plates 52. The holder plates 52, 52' have respective shoulders 523, 523' supported on the springs 55. Each of the actuating members 53 has one end pivoted to the corresponding pivot pin 521 and an opposite end supported on the support 54. The channel plate 51 has two horizontal rows of ball holes 511 at two opposite sides, and a plurality of steel balls 512 respectively turned in the ball holes 511 and held in place by the clamping plates 56, 56'. The holder plates 52, 52' have a respective row of holes 522 or 522', which receive the steel balls 512. The diameter of the holes 522, 522' is slightly smaller than that of the steel balls 512, therefore, the steel balls 512 can be maintained in the ball holes 511 of the channel plate 51. When assembled, the steel balls 512 partially projecting out of the ball holes 511 into the holes 522, 522' to hold the holder plates 52, 52' in the upper limit position in which the top ends of the holder plates 52, 52' protrude over the topmost edge of the channel plate 51. When sheets of paper are put in the stapling position, the holder plates 52, 52' are forced down, causing the actuating members 53 to be forced by the support 54 to turn inwardly upwards for bending the ends of the staple inwards upon a striking. The position of the anvil assembly 5 can be adjusted horizontally by turning the adjusting screws 57, or adjusted vertically by turning the elevation adjusting device 6.

Referring to FIGS. 5A, 5B, 5C, and 5D, the elevation adjusting device 6 has a polygonal cross section, and is fixedly mounted around a screw rod 61. The screw rod 61 is fastened to one end of the elevation adjusting device 6 at an eccentric location. When the screw rod 61 is rotated clockwise, the sides of the elevation adjusting device 6 are alternatively moved into contact with the bottom side of the anvil assembly 5, and the elevation of the anvil assembly 5 is relatively adjusted.

Figure 6:
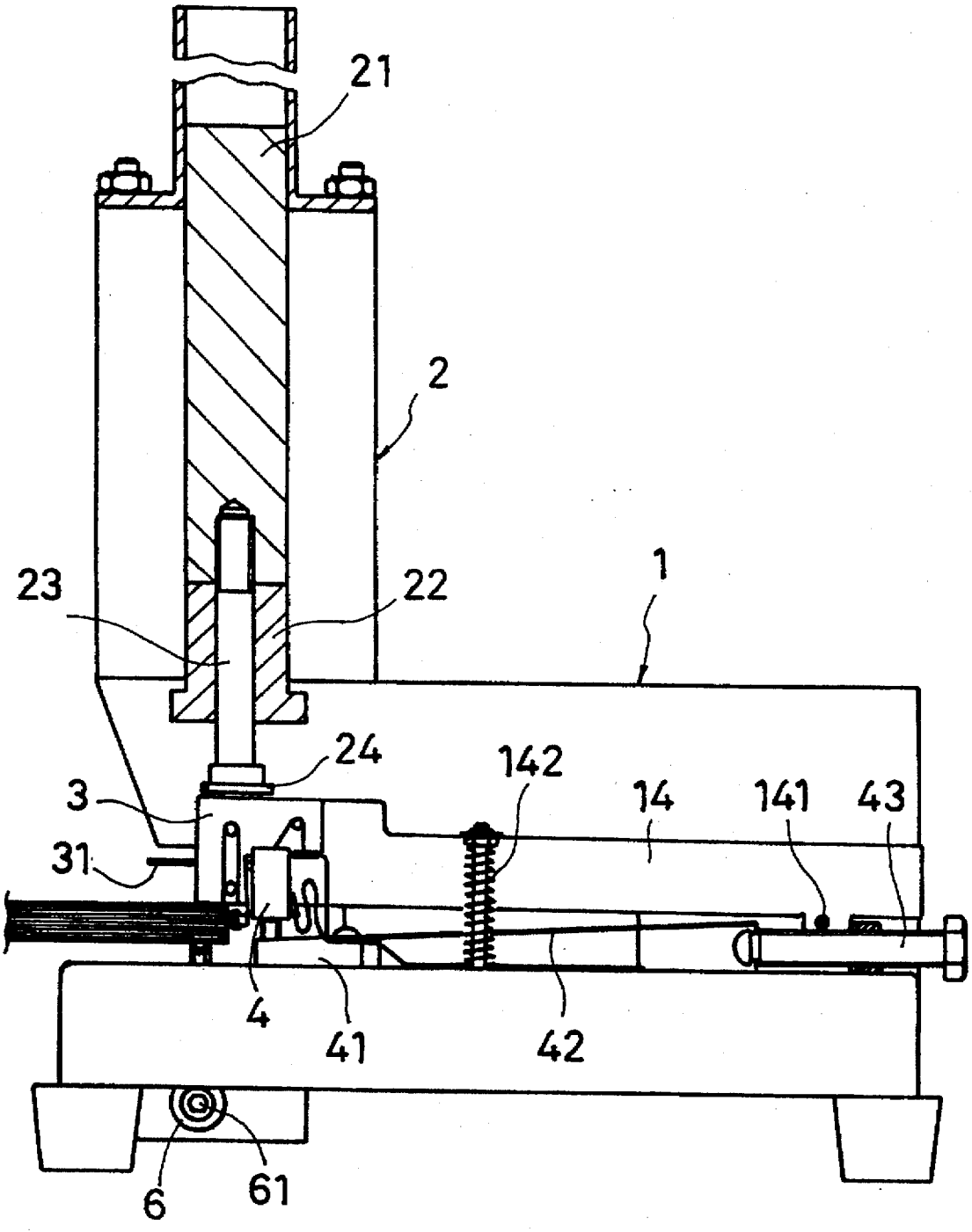
FIG. 6 is another sectional view of the present invention, showing the contact switch triggered by sheets of paper.

Referring to FIG. 6, a contact switch 4 is mounted on a switch carrier 41 and adapted for controlling the operation of the electromagnetic valve 2. The switch carrier 41 is fastened to the front end of a supporting arm 42. The rear end of the supporting arm 42 is threaded onto an adjusting screw 43 at the bottom frame 12. By turning the adjusting screw 43, the supporting arm 42 is moved forwards or backwards horizontally. The switch carrier 41 has an adjusting screw (not shown) for adjusting the elevation of the contact switch 4.

While only one embodiment of the present invention has been shown and described, it will be understood that various modifications and changes could be made without departing from the spirit and scope of the invention disclosed.

What the invention claimed is:

1. A power stapler comprising a base, a magazine mounted on said base to carry staples, a follow spring mounted in said magazine to push staples forwards, a spring-supported striking plate controlled to drive staples into sheet of paper, a contact switch, an electromagnetic valve controlled by said contact switch to drive said striking plate, a guard plate adapted for stopping staples in said magazine, an anvil assembly mounted in a hole in said base on which staples are hammered and deformed, and an anvil elevation adjusting device adapted for adjusting the elevation of said anvil assembly, wherein said electromagnetic valve is mounted on two upright frames above said base, comprising a valve rod vertically disposed at the top, a movable annular metal block disposed at the bottom, and a plunger having a top end fixedly connected to said valve rod and a bottom end inserted through said movable annular metal block and stopped above said spring-supported striking plate, said movable annular metal block being energized to attract said valve rod when said electromagnetic valve is turned on, causing said valve rod to force said plunger downwardly against said spring-supported striking plate, said movable annular metal block being simultaneously moved downwards with said valve rod when said valve rod is attracted by said movable annular metal block.

2. The power stapler of claim 1 wherein said magazine comprises two locating pins bilaterally disposed near a front end thereof, and three vertically spaced locating holes at one lateral side thereof near said locating pins; said guard plate comprises two locating grooves at two opposite lateral sides respectively and movably coupled to the locating pins of said magazine, a finger strip at a front side thereof for lifting by hand, and a springy locating element at one lateral side forced into engagement with one of the three vertically spaced locating holes of said magazine, the front end of said magazine being closed by said guard plate when said springy locating element is forced into engagement with the top one of the three vertically spaced locating holes of said magazine, said guard plate being opened from the front end of said magazine when said springy locating element is forced into engagement with the bottom one of the three vertically spaced locating holes of said magazine, said guard plate closing the upper half of the front end of said magazine when said springy locating element is forced into engagement with the intermediate one of the three vertically spaced locating holes of said magazine.

3. The power stapler of claim 1 wherein said anvil assembly comprises an anvil base, and two horizontal adjusting screws respectively fastened to said anvil base at two opposite sides and turned to adjust the position of said anvil base horizontally.

4. The power stapler of claim 1 wherein said anvil elevation adjusting device has a plurality of peripheral sides alternatively disposed in contact with the lowest side of said anvil assembly, and is fixedly mounted around a screw rod, said screw rod being fastened to one end of said elevation adjusting device at an eccentric location, the peripheral sides said elevation adjusting device being alternatively moved into contact with the lowest side of said anvil assembly to change the elevation of said anvil assembly relatively when said screw rod is rotated.

5. The power stapler of claim 1 wherein said contact switch is mounted on a switch carrier, said switch carrier being carried on a supporting arm, said supporting arm being threaded onto a switch horizontal position adjusting screw, said switch horizontal position adjusting screw being mounted on said base and turned to move said supporting arm forwards and backwards horizontally, said switch carrier having a switch elevation adjusting screw turned to adjust the elevation of said contact switch relative to said switch carrier.

* * * * *